US008827322B2

(12) United States Patent
Granger et al.

(10) Patent No.: US 8,827,322 B2
(45) Date of Patent: Sep. 9, 2014

(54) THREADED CONNECTION FOR DRILLING AND OPERATING HYDROCARBON WELLS

(75) Inventors: Scott Granger, Valenciennes (FR); Olivier Caron, Ramecourt (FR); Eric Verger, Gommegnies (FR)

(73) Assignees: Sumitomo Metal Industries, Ltd., Osaka-shi (JP); Vallourec Oil and Gas France, Aulnoye-Aymeries (FR)

( * ) Notice: Subject to any disclaimer, the term of this patent is extended or adjusted under 35 U.S.C. 154(b) by 161 days.

(21) Appl. No.: 13/319,130

(22) PCT Filed: May 7, 2010

(86) PCT No.: PCT/EP2010/002805
§ 371 (c)(1),
(2), (4) Date: Nov. 17, 2011

(87) PCT Pub. No.: WO2010/133299
PCT Pub. Date: Nov. 25, 2010

(65) Prior Publication Data

US 2012/0068458 A1 Mar. 22, 2012

(30) Foreign Application Priority Data

May 20, 2009 (FR) ..... 09 02497

(51) Int. Cl.
*F16L 15/00* (2006.01)
*F16L 15/06* (2006.01)

(52) U.S. Cl.
USPC ..... 285/334; 285/333

(58) Field of Classification Search
USPC ..... 285/333–334, 355, 390
See application file for complete search history.

(56) References Cited

U.S. PATENT DOCUMENTS

RE30,647 E 6/1981 Blose
4,600,224 A 7/1986 Blose
(Continued)

FOREIGN PATENT DOCUMENTS

FR 2 592 935 7/1987
JP 2003-42354 2/2003
(Continued)

OTHER PUBLICATIONS

International Preliminary Report on Patentability and Written Opinion issued Nov. 22, 2011, in PCT/EP2010/002805.
(Continued)

*Primary Examiner* — Aaron Dunwoody
*Assistant Examiner* — Fannie Kee
(74) *Attorney, Agent, or Firm* — Oblon, Spivak, McClelland, Maier & Neustadt, L.L.P.

(57) ABSTRACT

A set for manufacturing a threaded connection, including first and second tubular components with an axis of revolution, one of their ends including a threaded zone formed on the external or internal peripheral surface of the component depending on whether the threaded end is of male or female type, the ends finishing in a terminal surface. The threaded zones include, over at least a portion, threads including, viewed in longitudinal section passing through the axis of revolution of the tubular components, a thread crest, a thread root, a load flank, and a stabbing flank, the width of the thread crests of each tubular component reducing in the direction of the terminal surface of the tubular component under consideration, while the width of the thread roots increases, profiles of the load flanks and/or the stabbing flanks of the male and female threaded zones, viewed in longitudinal section passing through the axis of revolution of the tubular components, each having at least one identical portion such that the male and female threads can be fitted one into the other over the identical portions when the first and second tubular components are made up one into the other. The identical portions of the male and female ends are radially offset with respect to each other.

12 Claims, 4 Drawing Sheets

(56) References Cited

U.S. PATENT DOCUMENTS

| | | | |
|---|---|---|---|
| 4,688,832 | A | 8/1987 | Ortloff et al. |
| 5,154,452 | A | 10/1992 | Johnson |
| RE34,467 | E | 12/1993 | Reeves |
| 5,498,035 | A | 3/1996 | Blose et al. |
| 6,254,146 | B1 | 7/2001 | Church |
| 6,659,509 | B2 | 12/2003 | Goto et al. |
| 2003/0067169 | A1 | 4/2003 | Church |
| 2006/0220382 | A1 | 10/2006 | Reynolds, Jr. et al. |
| 2007/0216160 | A1 | 9/2007 | Reynolds, Jr. |
| 2008/0073909 | A1 | 3/2008 | Church |
| 2010/0171305 | A1 | 7/2010 | Roussie et al. |

FOREIGN PATENT DOCUMENTS

| | | |
|---|---|---|
| WO | 03 076837 | 9/2003 |
| WO | 2008 039317 | 4/2008 |

OTHER PUBLICATIONS

International Preliminary Report on Patentability and Written Opinion issued Oct. 18, 2011, in PCT/EP2010/002215.

International Preliminary Report on Patentability and Written Opinion issued Nov. 15, 2011, in PCT/EP2010/002682.

U.S. Appl. No. 13/260,138, filed Oct. 7, 2011, Granger, et al.

U.S. Appl. No. 13/319,410, filed Nov. 8, 2011, Granger, et al.

International Search Report Issued Nov. 5, 2010 in PCT/EP10/002805 Filed May 7, 2010.

THREADED CONNECTION FOR DRILLING AND OPERATING HYDROCARBON WELLS

The present invention relates to a set for manufacturing a threaded connection used for drilling and operating hydrocarbon wells, the set comprising a first and a second tubular component, one being provided with a male type threaded end and the other being provided with a female type threaded end, the two ends being capable of cooperating by self-locking make-up. The invention also relates to a threaded connection resulting from connecting two tubular components by make-up.

The term "component used for drilling and operating hydrocarbon wells" means any element with a substantially tubular shape intended to be connected to another element of the same type or not in order when complete to constitute either a string for drilling a hydrocarbon well or a riser for maintenance such as a work over riser, or for operation such as a production riser, or a casing string or a tubing string involved in operating a well. The invention is of particular application to components used in a drill string such as drill pipes, heavy weight drill pipes, drill collars and the parts which connect pipes and heavy weight pipes known as tool joints.

In known manner, each component used in a drill string generally comprises an end provided with a male threaded zone and/or an end provided with a female threaded zone each intended to be connected by make-up with the corresponding end of another component, the assembly defining a connection. The string constituted thereby is driven from the surface of the well in rotation during drilling; for this reason, the components have to be made up together to a high torque in order to be able to transmit a rotational torque which is sufficient to allow drilling of the well to be carried out without break-out or even over-torquing.

In conventional products, the make-up torque is generally achieved thanks to cooperation by tightening of abutment surfaces provided on each of the components which are intended to be made up. However, because of the fact that the extent of the abutment surfaces is a fraction of the thickness of the tubes, the critical plastification threshold of the abutment surfaces is reached rapidly when too high a make-up torque is applied.

For this reason, threadings have been developed which can relieve the abutment surfaces of at least a portion or even all of the loads which they are not capable of taking up. The aim was achieved by using self-locking threadings such as those described in the prior art document U.S. Re 30 647 and U.S. Re 34 467. In this type of self-locking threads, the flanks of the threads (also termed teeth) of the male end and the flanks of the threads (also termed teeth) of the female end have a constant lead but the thread widths are variable.

More precisely, the widths of the thread crests (or teeth) increase progressively for the threads of the male end, respectively the female end, with distance from the male end, respectively from the female end. Thus, during make-up the male and female threads (or teeth) finish up locking into each other in a position corresponding to a locking point. More precisely, locking occurs for self-locking threadings when the flanks of the male threads (or teeth) lock against the flanks of the corresponding female threads (or teeth). When the locking position is reached, the male and female threaded zones made up into each other have a plane of symmetry along which the widths at the common mid-height of the male and female teeth located at the end of the male threaded zone corresponds to the widths at the common mid-height of the male and female teeth located at the end of the female threaded zone.

For this reason, the make-up torque is taken up by all of the contact surfaces between the flanks, i.e. a total surface area which is much larger than that constituted by the abutment surfaces of the prior art.

In order to reinforce the interlock of the male threads with the female threads, the male and female threads (or teeth) usually have a generally dovetail profile so that they are solidly fitted one inside the other after make-up. This dovetail configuration means that risks of jump-out, corresponding to the male and female threads coming apart when the threaded zones are made up into each other, are avoided. More precisely, the geometry of dovetail threads increases the radial rigidity of their connection compared with "trapezoidal" threads as defined in API5B, where the axial width reduces from the base of the thread to the thread crest, and compared with "triangular" threads such as those defined in API7.

Further, because of the ever-increasing challenges as regards tightness to fluid, a reinforced degree of tightness, corresponding to high pressures at the threaded connection between two tubular components, must be guaranteed. To this end, in addition to the thread flanks ensuring the tightness, it is known to bring the thread crests and roots into tightening contact. Thus, the tightness is provided between the interior of the connection and the exterior of the connection at the threading per se.

However, the dovetail configuration suffers from several disadvantages when the thread crests and roots are brought into tightening contact during make-up. The fact that the thread flanks make a negative angle with the axis that passes through the thread roots (i.e. an angle which is the inverse of that used in the case of a trapezoidal thread configuration) increases the risks of the male and female threads galling when making up and breaking out a connection. This means that make-up progress is difficult and reduces the fatigue strength of the threads.

In order to overcome this problem, several documents such as U.S. Pat. No. 6,254,146, U.S. Pat. No. 4,600,024 and WO-2008/039317 propose a flank configuration using facets in order to reduce the contact pressure between the thread crests and thread roots during make-up. For this reason, the threads have a generally dovetail profile while reducing the surface area of the thread roots and thread crests. However, that configuration does not solve the problems of contact between the thread crests and roots to a sufficient extent.

For this reason, the aim of the invention is to conserve minimized contact pressures between the thread crests and thread roots during the make-up operation in order to guard against the problems of galling and to guarantee at the end of make-up (i.e. during the tightening operation which concludes connection) a high contact pressure between the thread crests and roots. This high contact pressure enables in particular to increase the tightness of the connection.

More precisely, the invention concerns a set for manufacturing a threaded connection, comprising a first and a second tubular component each with an axis of revolution, one of their ends being provided with a threaded zone formed on the external or internal peripheral surface of the component depending on whether the threaded end is of the male or female type, said ends finishing in a terminal surface, said threaded zones comprising, over at least a portion, threads comprising, viewed in longitudinal section passing through the axis of revolution of the tubular components, a thread crest, a thread root, a load flank and a stabbing flank, the width of the thread crests of each tubular component reducing in the direction of the terminal surface of the tubular component under consideration, while the width of the thread roots increases, the profiles of the load flanks and/or the stabbing flanks of the male and female threaded zones, viewed in longitudinal section passing through the axis of revolution of the tubular components, each having at least one identical portion such that the male and female threads can be fitted one into the other over said identical portions when the first and second tubular components are made up one into the other, characterized in that the identical portions of the male and female ends are radially offset with respect to each other.

Optional complementary or substitutional features of the invention are described below.

The distance of the identical portion of the profile of the load flanks and/or the stabbing flanks of the male threaded zone from the axis of revolution is smaller than the distance of the identical portion of the corresponding profile of the load flanks and/or the stabbing flanks of the female threaded zone from the axis of revolution.

The distance of the identical portion of the profile of the load flanks and/or the stabbing flanks of the male threaded zone from the axis of revolution is greater than the distance of the identical portion of the corresponding profile of the load flanks and/or the stabbing flanks of the female threaded zone from the axis of revolution.

The distance of the portion of the load flanks and/or the stabbing flanks of the male threaded zone from the axis of revolution differs from the distance of the corresponding fitting portion of the load flanks and/or the stabbing flanks of the female threaded zone from the axis of revolution by a value in the range 0.01 to 0.05 mm.

The distance of the portion of the load flanks and/or the stabbing flanks of the male threaded zone from the axis of revolution differs from the distance of the corresponding portion of the load flanks and/or the stabbing flanks of the female threaded zone from the axis of revolution by a value substantially equal to 0.02 mm.

The portion of the load flanks and/or the stabbing flanks of the male and female threaded zones is constituted by two segments connected together tangentially via a first radius of curvature.

The two segments connected together tangentially via a radius of curvature form an angle in the range 90 to 120 degrees.

The portion of the load flanks and/or the stabbing flanks of the male and female threaded zones is connected to the thread crest and/or root by means of a second radius of curvature.

The portion of the load flanks and/or the stabbing flanks of the male and female threaded zones is a continuous curve provided with a point of inflection, said curve being connected tangentially to the thread crest and to the root.

The threaded zones each have a taper generatrix forming an angle β with the axis of revolution of the tubular components.

The thread crests and roots are parallel to the axis of the tubular component.

The invention also concerns a threaded connection resulting from connecting a set in accordance with the invention by make-up.

In accordance with certain characteristics, the male and female ends of the connection each respectively comprise a sealing surface which can cooperate with each other in tightening contact when the portions of the threaded zones cooperate following self-locking make-up.

In accordance with other characteristics, the threaded connection is a threaded connection of a drilling component.

The characteristics and advantages of the invention are set out in more detail in the following description, made with reference to the accompanying drawings.

FIGS. 3*a*, 3*b*, 3*c*, 3*d*, 3*e* and 3*f* are each detailed longitudinal sectional views of male and female threads in accordance with particular embodiments of the invention.

Figure 3A:
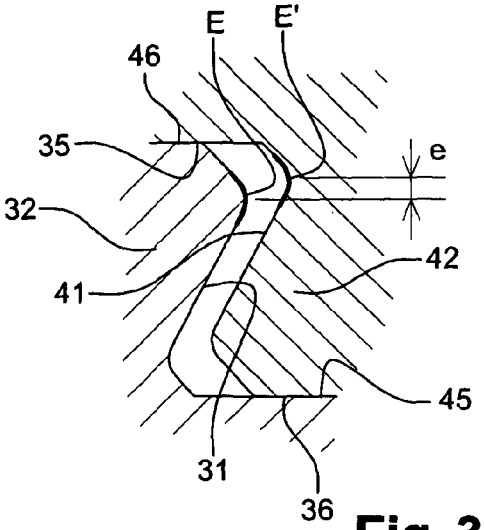
Figure 4:
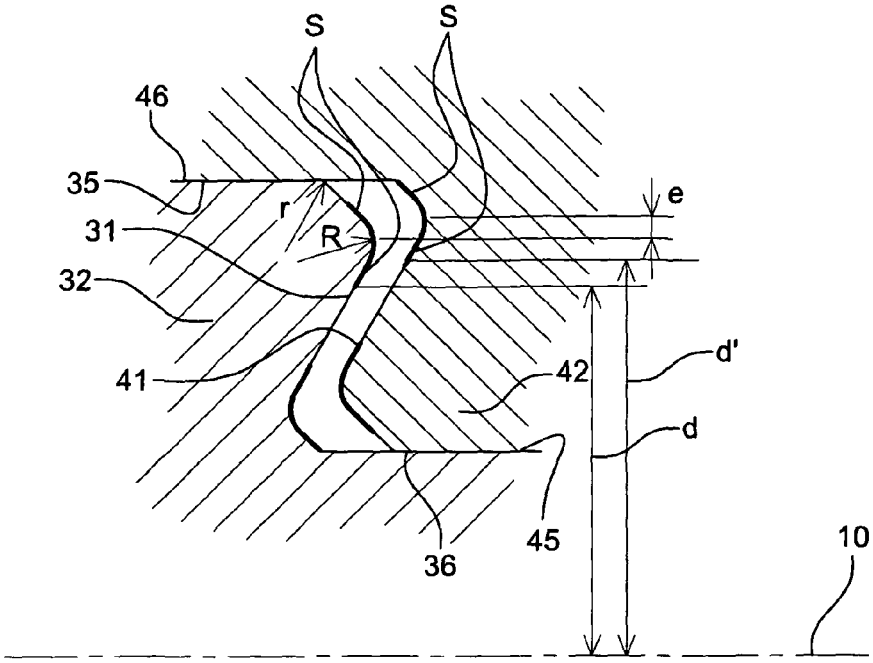
Figure 5:
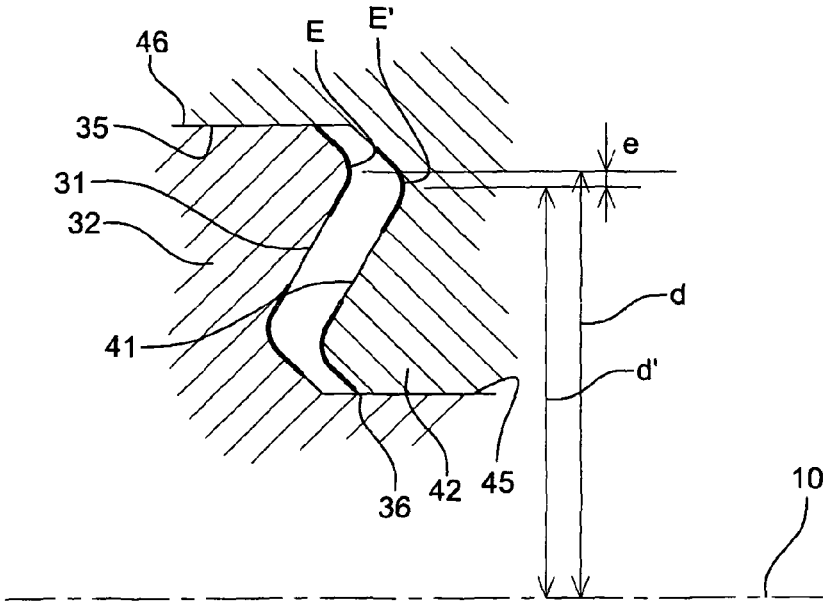

FIGS. 4 and 5 are detailed views of the particular embodiment shown in FIG. 3*a*.

Figure 6B:
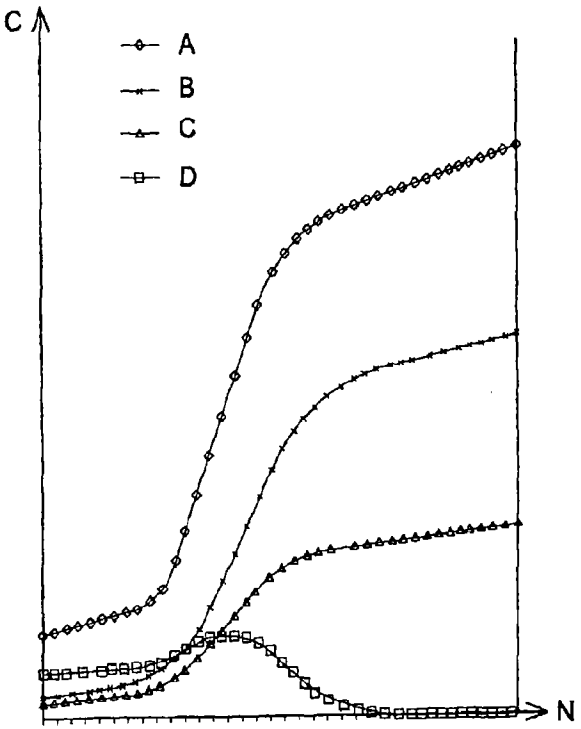
Figure 6A:
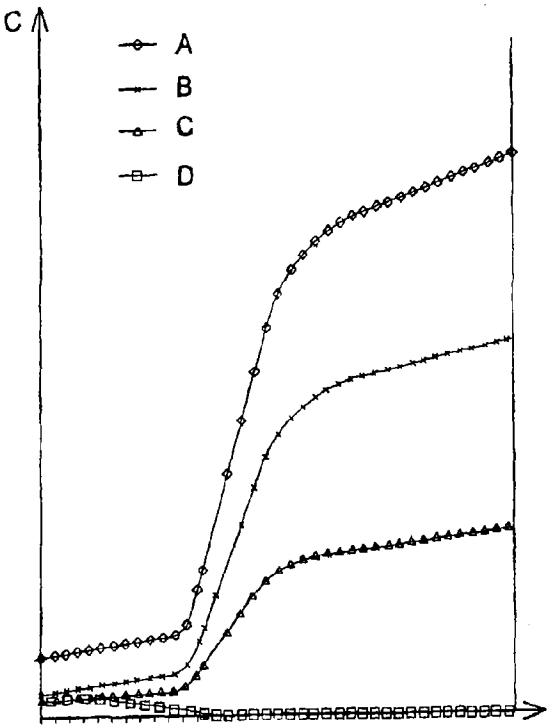
Fig. 6A PRIOR ART

FIG. 6*a* shows a make-up curve corresponding to make-up of a prior art connection.

FIG. 6*b* shows a make-up curve corresponding to make-up of a connection in accordance with an embodiment of the invention.

Figure 1A:
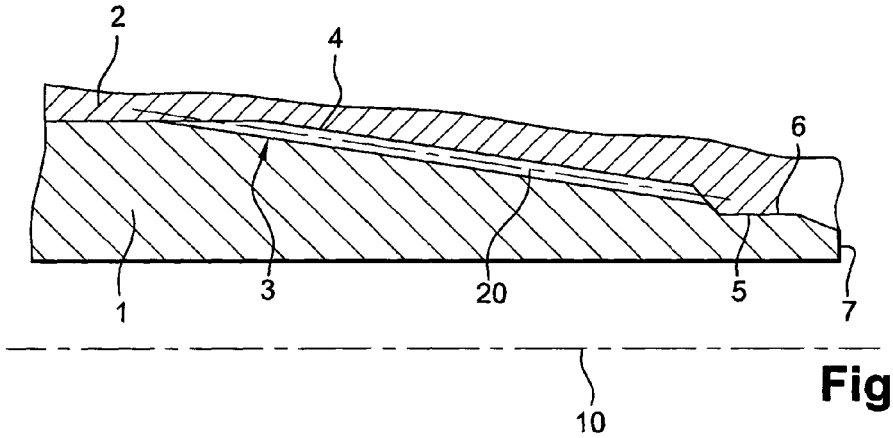
FIG. 1A is a diagrammatic view in longitudinal section of a connection resulting from coupling two tubular components by self-locking make-up in accordance with one embodiment of the invention.

The threaded connection shown in FIG. 1A and with axis of revolution 10 comprises, in known manner, a first tubular component with the same axis of revolution 10 provided with a male end 1 and a second tubular component with the same axis of revolution 10 provided with a female end 2.

Figure 1B:
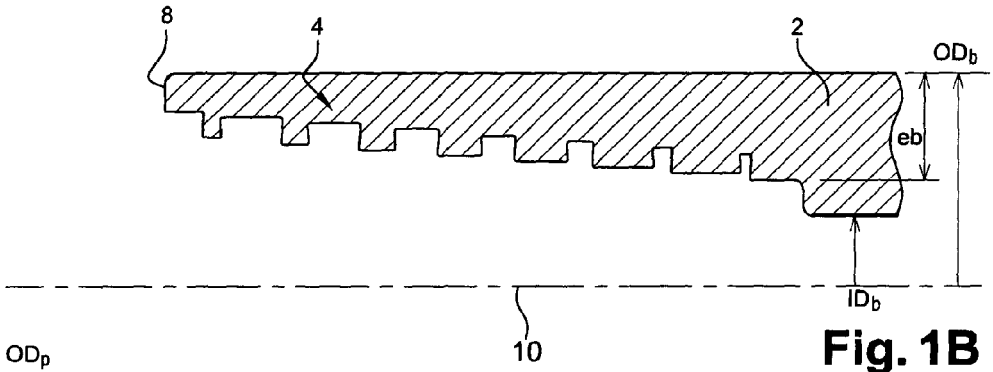
FIG. 1B is a diagrammatic view in longitudinal section of a female tubular component in accordance with one embodiment of the invention.
Figure 1C:
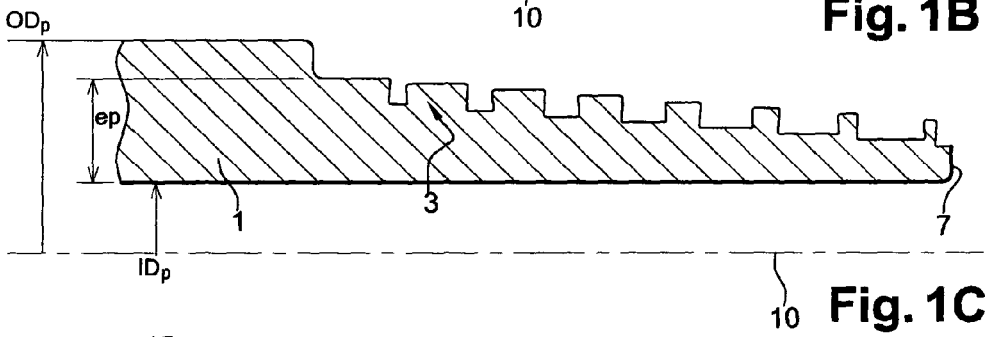
FIG. 1C is a diagrammatic view in longitudinal section of a male tubular component in accordance with one embodiment of the invention.

The tubular components shown respectively in FIGS. 1B and 1C each comprise ends 1 and 2, in known manner. Said ends each finish in a terminal surface 7, 8 which is orientated radially with respect to the axis 10 of the threaded connection, and are respectively provided with threaded zones 3 and 4 which cooperate together for mutual connection of the two elements by make-up. The threaded zones 3 and 4 are of known type known as "self-locking" (also said to have a progressive variation of the axial width of the threads and/or the intervals between threads), such that progressive axial tightening occurs during make-up until a final locking position is reached.

Figure 2:
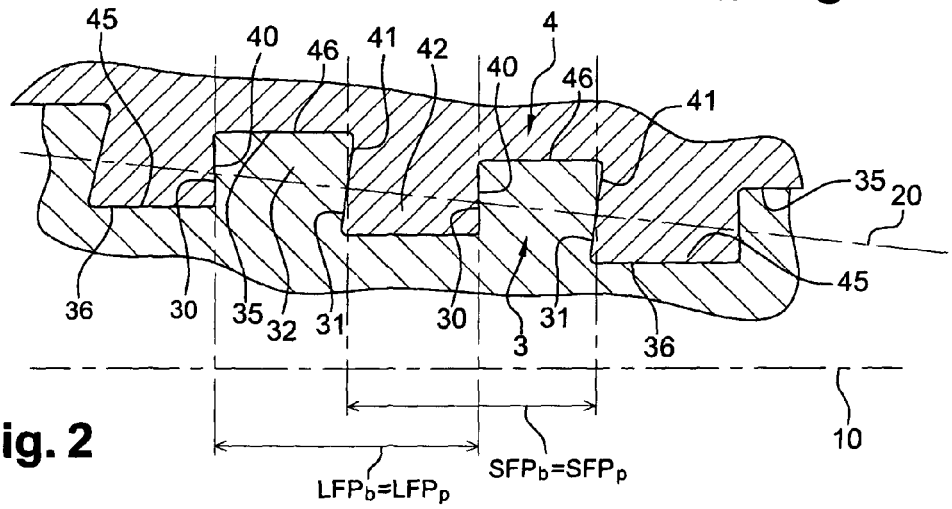
FIG. 2 is a detailed diagrammatic view in longitudinal section of threaded zones of the connection of FIG. 1.

In known manner and as can be seen in FIG. 2, the term "self-locking threaded zones" means threaded zones including the features detailed below. The flanks of the male threads (or teeth) 32, like the flanks of the female threads (or teeth) 42, have a constant lead while the width of the threads decreases in the direction of the respective terminal surfaces 7, 8, such that during make-up the male 32 and female 42 threads (or teeth) finish by locking into each other in a predetermined position. More precisely, the lead LFPb between the load flanks 40 of the female threaded zone 4 is constant, as is the lead SFPb between the stabbing flanks 41 of the female threaded zone, wherein in particular the lead between the load flanks 40 is greater than the lead between the stabbing flanks 41.

Similarly, the lead SFPp between the male stabbing flanks 31 is constant, as is the lead LFPp between the male load flanks 30. Further, the respective leads SFPp and SFPb between the male 31 and female 41 stabbing flanks are equal to each other and are smaller than the respective leads LFPp and LFPb between the male 30 and female 40 load flanks, which are also equal to each other.

As can be seen in FIG. 2, the male and female threads (or teeth) have a profile, viewed in longitudinal section passing through the axis of the threaded connection 10, which has the general appearance of a dovetail such that they are solidly fitted one into the other after make-up. This additional guarantee means that risks known as "jump-out", corresponding to the male and female threads coming apart when the connection is subjected to large bending or tensile loads, are avoided. More precisely, the geometry of the dovetail threads increases the radial rigidity of their connection compared with threads which are generally termed "trapezoidal" with an axial width which reduces from the base to the crest of the threads.

Advantageously and as can be seen in FIG. 2, the threadings 3 and 4 of the tubular components are orientated along a taper generatrix 20 so as to facilitate the progress of make-up. In general, this taper generatrix forms an angle with the axis 10 which is included in a range from 1 degree to 5 degrees. In the present case, the taper generatrix is defined as passing through the middle of the load flanks.

Advantageously and as can be seen in FIG. 2, the crests of the teeth and the roots of the male and female threaded zones are parallel to the axis 10 of the threaded connection. This facilitates machining.

FIGS. 3*a*, 3*b*, 3*c*, 3*d*, 3*e*, 3*f*, 4 and 5 each show a longitudinal sectional view of a male thread 32 and a female thread 42 each belonging to a tubular component. These tubular components constitute a set in accordance with the invention. Each of the Figures shows the profiles of the male 31 and female 41 stabbing flanks viewed along a longitudinal section passing through the axis of revolution 10 of the tubular components. This axis is also the axis of revolution of the connection. In accordance with the invention, the profile of the male 31 stabbing flanks and the profile of the female 41 stabbing flanks each has an identical portion E, E'. More precisely, these portions are identical such that from a graphical viewpoint, they can be superimposed one on the other.

Further, the male and female threads can be fitted one into the other over these identical portions E, E' when the tubular components are made up one into the other. The term "fitted" means that the identical portions have a certain convexity and/or a certain concavity such that they are complementary and they can be fitted one into the other. This means that when the flanks (load or stabbing) of the corresponding male and female threads (also known as teeth) are fitted one against the other, said threads can no longer translate with respect to each other along an axis perpendicular to the axis of revolution 10.

Again in accordance with the invention, the distance d of the portion E of the profile of the stabbing flanks of the male threaded zone from the axis of revolution 10 is different from the distance d' of the portion E' of the profile of the stabbing flanks of the female threaded zone from the axis of revolution 10. For this reason, the portions E and E' are offset with respect to each other radially, i.e. with respect to the axis of revolution 10. The term "distance d of the portion E from the axis of revolution 10" means the separation of said portion from the axis of revolution 10. In other words, the portions E and E' can be fitted one into the other but do not face each other. In order to fit them one into the other it is not sufficient to carry out a translation from the axis of revolution 10. In addition, a translation along an axis perpendicular to the axis of revolution 10 must be carried out.

According to the embodiments shown in FIGS. 3*a*, 3*b*, 3*c*, 3*d*, 3*e*, 3*f* and 4, the distance d of the portion E of the profile of the stabbing flank of the male threaded zone from the axis of revolution 10 is less than the distance d' of the portion E' of the profile of the stabbing flanks of the female threaded zone from the axis of revolution 10.

According to the embodiment shown in FIG. 5, the distance d of the portion E of the profile of the stabbing flanks of the male threaded zone from the axis of revolution 10 is greater than the distance d' of the portion E' of the profile of the stabbing flanks of the female threaded zone with respect to the axis of revolution 10.

According to the embodiments shown in FIGS. 3*a*, 3*b*, 3*c*, 3*d*, 3*e*, 3*f* and 4, the identical portions E, E' are offset with respect to each other radially along an axis perpendicular to the axis of revolution 10. Thus, during make-up, the thread crests do not interfere with the thread roots. They may also exhibit a certain clearance. In contrast, when the male and female flanks lock one against the other at the end of make-up, the clearance due to the offset of the identical portions tends to be reduced to cancel out under the final make-up force. This means that the initially offset identical portions E and E' are brought face to face and finish by being pressed one against the other. At the same time, the roots and crests of the male and female threads are also pressed against one another under the effect of elastic deformations. Depending on the magnitude of the initial clearance present between the thread roots and thread crests, at the end of make-up, thread roots and crests may be in contact under pressures which may be large or small. The tightness of the threading is thus ensured by the fact that the male and female threads are in tightening contact at the load flanks, the stabbing flanks and at the thread crests and roots.

In the embodiment shown in FIG. 5, the thread crests are in contact with the thread roots at a contact pressure which is selected so as to avoid galling. In contrast, when the initially offset identical portions E and E' are brought face to face to finish by being pressed against each other, the roots and crests of the male and female threads remain pressed against each other under a conserved contact pressure.

In all cases and regardless of the embodiment of the invention, elastic deformation of the male and/or female flank profiles occurs such that the profile of the male flanks and the profile of the female flanks are different from each other before make-up and match each other after make-up. The tightness of the threading is ensured by the fact that at the end of make-up, the male and female threads are in tightening contact at the load flanks, the stabbing flanks and at the thread crests and roots.

FIG. 6A shows a make-up curve for a conventional self-locking radial tightening threading. It appears that the variation in the torque applied during make-up at the thread roots and crests is almost zero (see curve D), while the variation in the torque applied during make-up at the load flanks and at the stabbing flanks (see curves C and B) increases. Clearly, the variation in the torque applied during make-up at the threaded zone taken as a whole also increases (see curve A), this latter being taken up, in a conventional manner, by the stabbing flanks and more particularly by the load flanks.

In contrast, in the case of a self-locking radial tightening threading in accordance with an embodiment of the invention, it appears that the variation in the torque applied during make-up at the thread crests and roots has a peak (see curve D, FIG. 6B), which corresponds to the force for fitting the identical portions E and E' one into the other. This torque returns to almost zero at the end of make-up so that the total torque is taken up by the stabbing flanks and more particularly by the load flanks.

Advantageously, the distance d of the portion E of the profile of the stabbing flanks of the male threaded zone from the axis of revolution 10 differs from the distance d' of the portion E' of the profile of the stabbing flanks of the female threaded zone from the axis of revolution 10 by a value e in the range 0.01 to 0.05 mm. Thus, the final make-up force which allows complete fitting of the male and female flanks is in the range 15% to 30% of the maximum applicable force.

Preferably again, the distance d of the portion E of the profile of the stabbing flanks of the male threaded zone from the axis of revolution 10 differs from the distance d' of the portion E' of the profile of the stabbing flanks of the female threaded zone from the axis of revolution 10 by a value e which is substantially equal to 0.02 mm. This means that the thread crest/root contact can be optimized without reaching the plastification limit of the material.

According to an advantageous embodiment described in FIG. 3*a* and detailed in FIG. 4, the portions E, E' of the profiles of the stabbing flanks of the male and female threaded zones are constituted by two segments S connected together tangentially via a radius of curvature R. This means that the portions of the flanks which can be fitted one into the other are inclined planar surfaces which act as a ramp, facilitating fitting of the flanks one into the other. The tangential connection by means of a radius of curvature R means that sharp angles, which are seats of stress concentrations, can be avoided.

Advantageously, the two segments which are tangentially connected via a radius of curvature form an angle in the range 90 to 120 degrees. This range of values means that a profile can be obtained with a convexity, or respectively concavity, of the male flanks, respectively the female flanks, is controlled. This enables to optimize the fatigue strength of connections which are subjected to bending and tension/compression stresses. This means that engagement and disengagement of the male and female elements is facilitated.

Advantageously, the identical portions E, E' of the profiles of the stabbing flanks of the male and female threaded zones are connected to the thread crest 35, 45 and to the thread root 36, 46 via a radius of curvature r, also in order to avoid sharp angles.

Figure 3B:
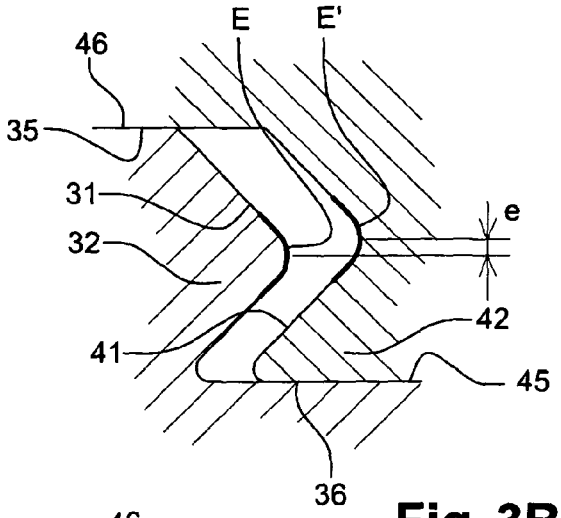

In accordance with another embodiment detailed in FIG. 3*b*, the identical portions E, E' of the stabbing flanks of the male and female threaded zones are also two segments connected together tangentially via a radius of curvature, the segments being substantially equal in length.

Figure 3C:
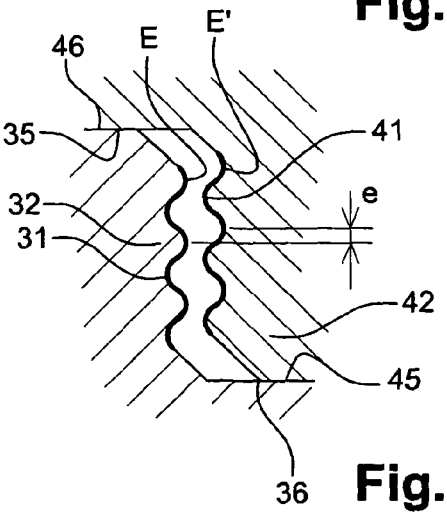
Figure 3D:
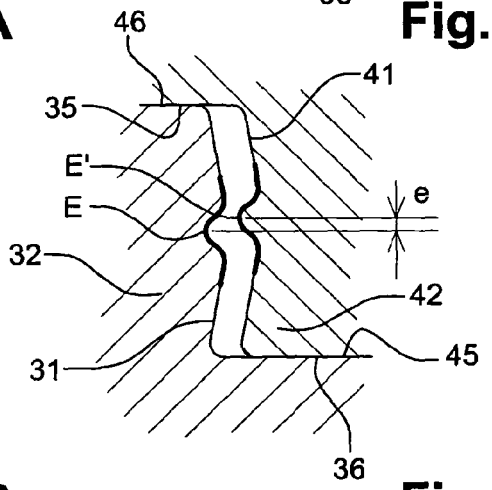

In accordance with two other similar embodiments detailed in FIGS. 3*c* and 3*d*, the identical portions E, E' of the stabbing flanks of the male and female threaded zones comprise one or more bulges which allow adjustable fitting of the profiles as a function of the dimension of the bulge.

Figure 3E:
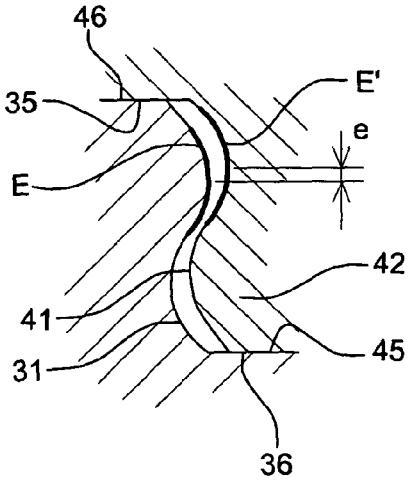

In accordance with another embodiment detailed in FIG. 3*e*, the identical portions E, E' of the stabbing flanks of the male and female threaded zones are a continuous curve with no singular point and provided with a point of inflection. Preferably, as explained above, said curve is connected tangentially to the thread crest and root by means of a radius of curvature.

Figure 3F:
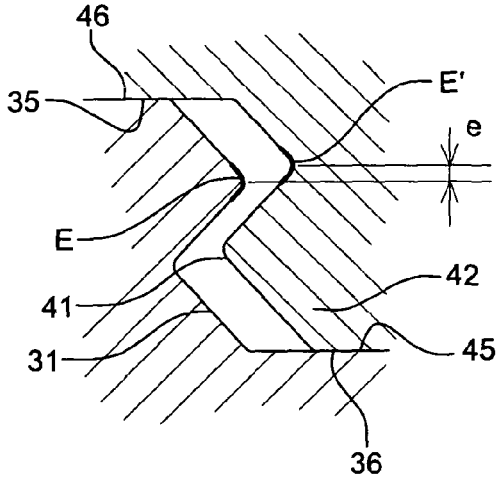

The embodiment shown in FIG. 3*f* is a mode which is similar to that shown in FIG. 3*a*. In this mode, the function of the ramp of segments S is reinforced.

Advantageously and as can be seen in FIG. 1, the fluid-tight seal, both towards the interior of the tubular connection and the external medium, may be reinforced by two sealing zones 5, 6 located close to the terminal surface 7 of the male element.

It is necessary to guarantee a higher degree of tightness corresponding to high pressures at the connection between two components. To this end, in other types of connections such as the YAM® TOP connections described by the Applicant in catalogue no 940, it is known to provide a sealing surface intended to cooperate in a radial tightening with a sealing surface provided on the female end of the connection on the male end of the connection beyond the threaded zone.

The sealing zone 5 may have a domed surface which is turned radially outwardly, with a diameter which decreases towards the terminal surface 7. The radius of this domed surface is preferably in the range 30 to 100 mm. Too high a radius (>150 mm) of the domed surface induces disadvantages which are identical to those of cone-on-cone contact. Too small a radius (<30 mm) of this domed surface induces an insufficient contact width.

Facing this domed surface, the female end 2 has a tapered surface which is turned radially inwardly with a diameter which also decreases in the direction of the terminal surface 7 of the male element. The tangent of the peak half angle of the tapered surface is in the range 0.025 to 0.075, i.e. a taper in the range 5% to 15%. Too low a taper (<5%) for the tapered surface induces a risk of galling on make-up and too high a taper (>15%) necessitates very tight machining tolerances.

The inventors have discovered that such a contact zone between a tapered surface and a domed surface enables to produce a high effective axial contact width and a substantially semi-elliptical distribution of contact pressures along the effective contact zone, in contrast to contact zones between two tapered surfaces which have two narrow effective contact zones at the ends of the contact zone.

It should be noted that the sealing zones 5 and 6 of the male and female end may be disposed close to the terminal surface 8 of the female end.

It should be noted that the invention may also be applied to the load flanks and not simply to the stabbing flanks. Similarly, the invention may be applied to only a portion of the stabbing flanks or to only a portion of the load flanks. This has the advantage of reducing the final make-up force, but also has the disadvantage of reducing the tightness of the connection. In accordance with the invention, it is at the end of make-up that the clearances which still exist between the male and female flanks and between the corresponding thread roots and crests disappear completely. At this moment the connection is sealed.

The invention has a further advantage of providing optimized management of the flows of lubricants used to facilitate make-up. The fact that clearances are retained at the thread flanks until the very end of make-up means that lubricant can move more uniformly over the threaded zones. This also avoids trapping of the lubricant in the threaded zones.

The invention claimed is:

1. A threaded connection, comprising:

a first and a second tubular component with an axis of revolution, one of their ends including a threaded zone formed on an external or internal peripheral surface of the component depending on whether the threaded end is male or female, the ends finishing in a terminal surface, the threaded zones comprising, over at least a portion, threads comprising, viewed in longitudinal section passing through the axis of revolution of the tubular components, thread crests, a width of the thread crests of each tubular component reducing in the direction of the terminal surface of the tubular component under consideration, thread roots, a width of the thread roots of each tubular component increasing in the direction of the terminal surface of the tubular component under consideration, load flanks, and stabbing flanks with, viewed in a longitudinal section passing through the axis of revolution of the tubular components, at least one of the male load flanks or the male stabbing flanks having first profiles, and at least one of the female load flanks or the female stabbing flanks having second profiles, wherein the first profiles and the second profiles have at least one identical portion such that the male and female threads can be fitted one into the other over the identical portions of the first and second profiles when the first and second tubular components are made up one into the other, wherein the identical portions of the first and second profiles are radially offset with respect to each other during make-up, and wherein the identical portions of the first and second profiles include a first at least one convex or concave segment on the first profile, and a second at least one concave or convex segment on the second profile which complements the first at least one convex or concave segment on the first profile.

2. A threaded connection according to claim 1, wherein a distance of the portion of at least one of the load flanks or the stabbing flanks of the male threaded zone from the axis of revolution is smaller than a distance of the corresponding portion of the corresponding flanks of the female threaded zone from the axis of revolution.

3. A threaded connection according to claim 1, wherein a distance of the portion of at least one of the load flanks or the stabbing flanks of the male threaded zone from the axis of revolution is greater than a distance of the corresponding portion of the corresponding flanks of the female threaded zone from the axis of revolution.

4. A threaded connection according to claim 1, wherein a distance of the portion of at least one of the load flanks or the stabbing flanks of the male threaded zone from the axis of revolution differs from a distance of the portion of the corresponding flanks of the female threaded zone from the axis of revolution by a value in a range of 0.01 to 0.05 mm.

5. A threaded connection according to claim 4, wherein the distance of the portion of the at least one of the load flanks or the stabbing flanks of the male threaded zone from the axis of revolution differs from the distance of the portion of the corresponding flanks of the female threaded zone from the axis of revolution by a value substantially equal to 0.02 mm.

6. A threaded connection according to claim 1, wherein the portions of the load flanks and/or the stabbing flanks of the male and female threaded zones are constituted by two segments connected together tangentially via a first radius of curvature.

7. A threaded connection according to claim 6, wherein the two segments connected together tangentially via a radius of curvature form an angle in a range 90 to 120 degrees.

8. A threaded connection according to claim 1, wherein the identical portions of at least one of the load flanks or the stabbing flanks of the male and female threaded zones are connected to at least one of the thread crest or root by a radius of curvature.

9. A threaded connection according to claim 1, wherein the threaded zones each include a taper generatrix forming an angle with the axis of revolution of the tubular components.

10. A threaded connection according to claim 1, wherein the thread crests and roots are parallel to the axis of the tubular component.

11. A threaded connection according to claim 1, wherein the male and female ends each respectively comprise a sealing surface, each sealing surface configured to cooperate in tightening contact with each other when the portions of the threaded zones cooperate following self-locking make-up.

12. A threaded connection according to claim 11, wherein the threaded connection is a threaded connection of a drilling component.

* * * * *

UNITED STATES PATENT AND TRADEMARK OFFICE

CERTIFICATE OF CORRECTION

PATENT NO. : 8,827,322 B2
APPLICATION NO. : 13/319130
DATED : September 9, 2014
INVENTOR(S) : Granger et al.

It is certified that error appears in the above-identified patent and that said Letters Patent is hereby corrected as shown below:

In the Specification

Column 7, line 63, change "YAM® TOP" to --VAM® TOP--.
Column 7, line 64, change "no 940," to --n° 940,--.

In the Claims

Column 10, line 6, change "and/or" to --or--.
Column 10, line 8, delete "first" before radius.

Signed and Sealed this
Sixteenth Day of June, 2015

Michelle K. Lee

Michelle K. Lee
*Director of the United States Patent and Trademark Office*